US005534834A

United States Patent [19]

Hendel

[11] Patent Number: 5,534,834

[45] Date of Patent: Jul. 9, 1996

[54] ARMATURE MOUNT FOR AN ELECTROMAGNETIC RELAY

[75] Inventor: Horst Hendel, Berlin, Germany

[73] Assignee: Siemens Aktiengesellschaft, Munich, Germany

[21] Appl. No.: 513,616

[22] Filed: Aug. 10, 1995

[30] Foreign Application Priority Data

Aug. 19, 1994 [DE] Germany ..... 44 29 552.9

[51] Int. Cl.[6] ..... H01H 51/22

[52] U.S. Cl. ..... 335/78; 335/80

[58] Field of Search ..... 335/78–86, 124, 335/128, 130, 131

[56] References Cited

U.S. PATENT DOCUMENTS

| | | | |
|---|---|---|---|
| 4,684,910 | 8/1987 | Dittmann et al. . | |
| 5,083,104 | 1/1992 | Bassino | 335/128 |
| 5,151,675 | 9/1992 | Biehl et al. | 335/78 |
| 5,155,458 | 10/1992 | Gamble | 335/80 |
| 5,319,331 | 6/1994 | Hirawata et al. | 335/78 |
| 5,475,352 | 12/1995 | Hoffmann et al. | 335/78 |

FOREIGN PATENT DOCUMENTS 3528715 2/1987 Germany .

*Primary Examiner*—Lincoln Donovan
*Attorney, Agent, or Firm*—Hill, Steadman & Simpson

[57] ABSTRACT

In a relay system, a flat yoke leg (21) is provided at which a plate-shaped armature (3) is seated via an armature spring (10). The flat yoke leg is arranged generally parallel to an axis of a relay coil core (1). An armature plate (3) has an end face seated at a broad underside of the yoke leg (21). A bearing section (12) of the armature spring lies against an end face of the yoke leg (21) and extends to lie flatly against the armature, to which it is preferably secured. A pre-stress section (13) of the armature spring extends axially beyond the bearing section (12) and is hooked and biased against a retainer peg (25) fashioned as an extension of the yoke leg. As a result thereof, the armature is urged against a bearing edge (22) at the underside of the yoke leg. Moreover, the armature is biased into a normal quiescent position with a predetermined force which is adjustably dependent on the deflectable position of the retainer peg.

20 Claims, 2 Drawing Sheets

ARMATURE MOUNT FOR AN ELECTROMAGNETIC RELAY

BACKGROUND OF THE INVENTION

The present invention is generally directed to an armature mount for an electromagnetic relay. More specifically, the present invention is directed to an armature mount having a spring-biased contact between the armature and yoke elements.

A relay armature mount is disclosed in DE 35 28 715 A1. An armature plate therein is positioned against an end face of a yoke leg, whereby it has a recess in the region of a respective retainer peg. In a bearing region, an armature spring is positioned against the armature plate opposite the yoke end face, the spring being bent outward away from the yoke leg and having a retainer tab secured on a smooth surface of a retainer peg or pegs. This is done by a welding process or in some similar way due, for example, to the effective forces. Disadvantageously, the bearing point of the armature does not coincide with the motion axis of the spring. Thus, the armature must slide against the spring during deflection, requiring the system to undesirably tolerate and overcome a certain amount of friction.

An object of the present invention is to create, an armature mount having an armature with an extremely low-friction and low-abrasion armature bearing. Another object of the present invention is to provide a system with few parts and in which the armature together with the spring are easily mounted with few, simple work steps. In addition, clamping effects between armature, yoke and spring should be avoided.

SUMMARY OF THE INVENTION

The objects are inventively achieved by providing an armature mount having a flat yoke leg arranged generally parallel to an axis of a relay coil core, the end face of the yoke leg forming a bearing edge for a plate-shaped armature as well as having at least one retainer peg projecting beyond the end face. The armature is arranged at approximately a right angle relative to the yoke leg and forms a working air gap together with the coil core. The mount further has an armature spring formed of sheet metal that has a bearing section secured to lie flat on a side of the armature facing away from the coil core, being held at the retainer peg with a pre-stress.

According to the invention, a bearing edge is formed between the end face and a broad side of a yoke leg facing toward the core. The armature has its end face seated at the broad side of the yoke leg. An armature spring has its bearing section lying on the end face of the yoke leg. A pre-stress section of the armature spring is seated at the armature spring with such a pre-stress that the inside bearing edge formed between the bearing section of the spring and the armature end face is used to press against the bearing edge of the yoke leg.

In the inventive armature mount, thus, the armature does not lie against the end face of the yoke leg as in most traditional cases. On the contrary, it has its own end face seated at the broad underside of the yoke leg, whereby the end face of the armature together with the armature spring form an inside bearing edge that embraces the bearing edge formed by the end of the yoke leg. The bearing axis of the armature and that of the spring thus coincide, so that the friction in the bearing is minimized. Due to the direction of the forces with which the armature is pressed into the bearing, it is also adequate to simply hook the pre-stress section of the armature spring into a notch or the like of the retainer peg proceeding from the outside of the yoke that faces away from the armature. Simple assembly derives as a result thereof since a welding process or the like is not required. (The connection of the armature to the armature spring by welding or riveting already ensues before the mounting thereof on the yoke.)

Given the type of armature bearing at the broad side of the yoke leg provided in the present invention, the armature can remain in contact with the yoke leg over the entire yoke width, even without incisions, resulting in an effective magnetic transmission since neither the armature spring nor the retainer peg cut through the bearing edge. In order to create freedom of motion for the armature in the bearing without this having to be produced solely by the elasticity of the armature spring in the bearing region, the bearing edge should comprise a smaller angle in cross section than the inside edge formed between the armature end face and the bearing section of the spring, whereby the restoring force for the armature is predetermined by selecting the point of attachment of the pre-stress section of the spring at the retainer peg. The point of attachment and, thus, the restoring force can be adjusted by deformation of the retainer peg, i.e. by bending around an axis parallel to the bearing edge. Expediently, the pre-stress section and the retainer peg engage one another with non-positive lock such that the spring and the armature are secured against dislocation from the yoke in a direction parallel to the bearing axis.

In a preferred embodiment, the salient retainer peg or, respectively, additional yoke steps divide the bearing edge into two edge sections separated from one another, whereby the bearing sections of the armature spring correspond to the edge sections. Each bearing section is formed by two spring webs between which the pre-stress section freely extends. Although an inverse embodiment would also be conceivable wherein a middle edge section with a bearing section of the armature spring would be provided between two lateral retainer pegs and two spring pre-stress sections, the stability of the armature guidance would be lower in this case due to the narrower seating base of the armature spring on the yoke leg.

In a preferred embodiment, further, the armature spring is fashioned such that the pre-stress section and the bearing section, i.e., the spring webs, are interconnected side-by-side at a common end section of the spring and are lent their mutual pre-stress by opposite, elastic spreading out of the plane of the end section of the spring. This common end section of the spring expediently extends parallel to the outer broad side of the yoke leg, whereas the bearing section and the pre-stress section of the armature spring, respectively offset relative to one another, are respectively bent off L-shaped toward the armature or, respectively, the retainer peg. Expediently, the common spring section extends parallel to the yoke leg at a certain spacing therefrom, and as a result the spring deflects with armature movement and provides a softer spring characteristic.

It is also advantageous that a central recess shapes the pre-stress section into a spring clip with a comparatively slight cross section that is supported in an insertion notch of the retainer peg. The cross-web of the spring clip hooked to the retainer peg is thereby arcuately shaped toward the inside, resulting in protection of the armature against dislocation in the direction of the bearing axis.

Thus, an advantage of the present invention is to provide an armature mount in which the armature is easily movable with low friction.

Another advantage is to provide an armature mount which has few parts.

A further advantage is to provide an armature mount which is easily assembled with few manufacturing steps.

Still another advantage is to provide an armature mount with an adjustable spring tension.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
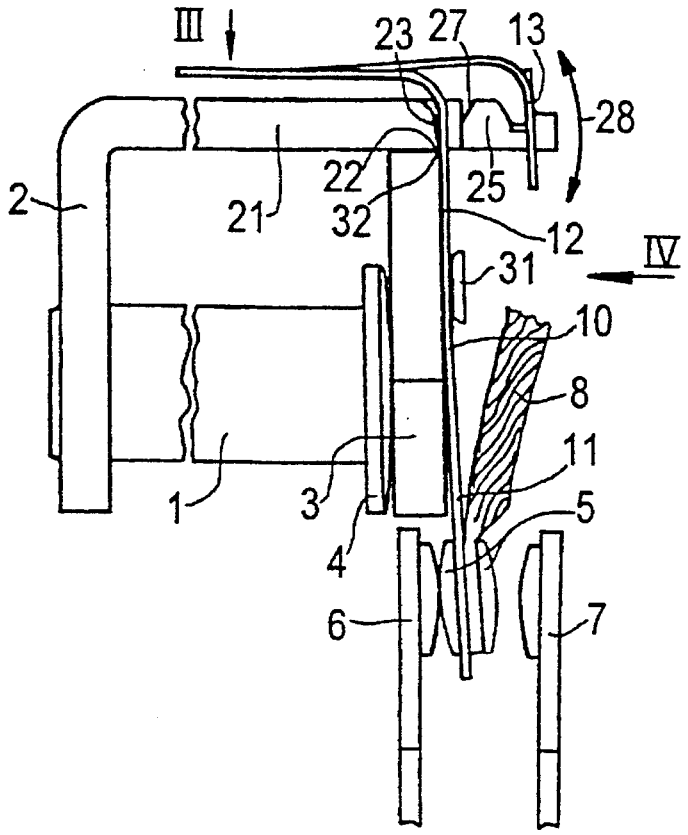
FIG. 1 illustrates a partial schematic side elevation view of a relay (without base member and coil) with an inventive armature mount.
Figure 2:
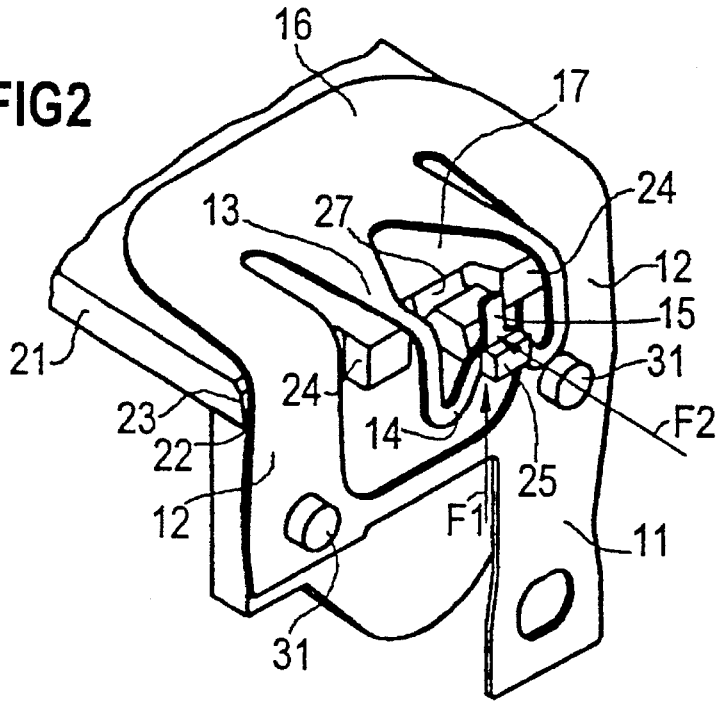
FIG. 2 illustrates a perspective view of the armature mount of FIG. 1.
Figure 3:
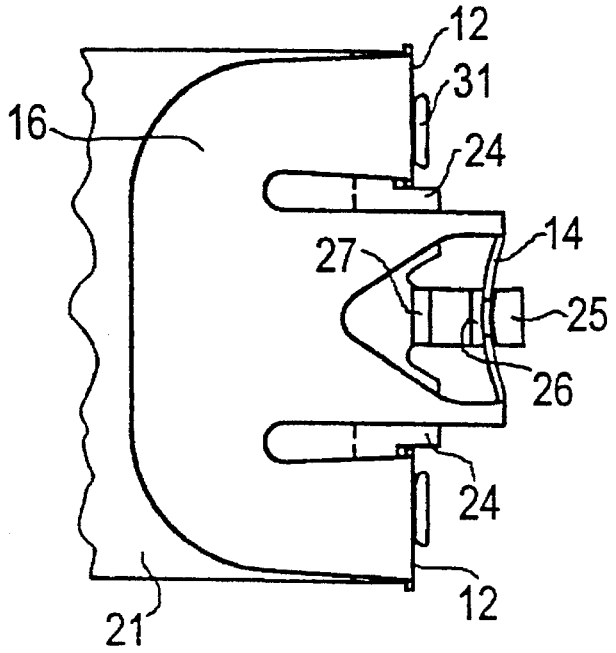
FIG. 3 illustrates a top plan view of the armature mount of FIG. 1.

The relay shown in the drawing has a core 1 in a base member or coil body that is not shown, this core 1 being connected to an L-shaped yoke 2, whereby a free yoke leg 21 extends parallel to the core 1. An armature 3 is seated against an underside surface of the yoke leg 21 and forms a normally-open air gap relative to pole plate 4 of the core 1. It is held and biased via an armature spring 10 as set forth below.

Figure 4:
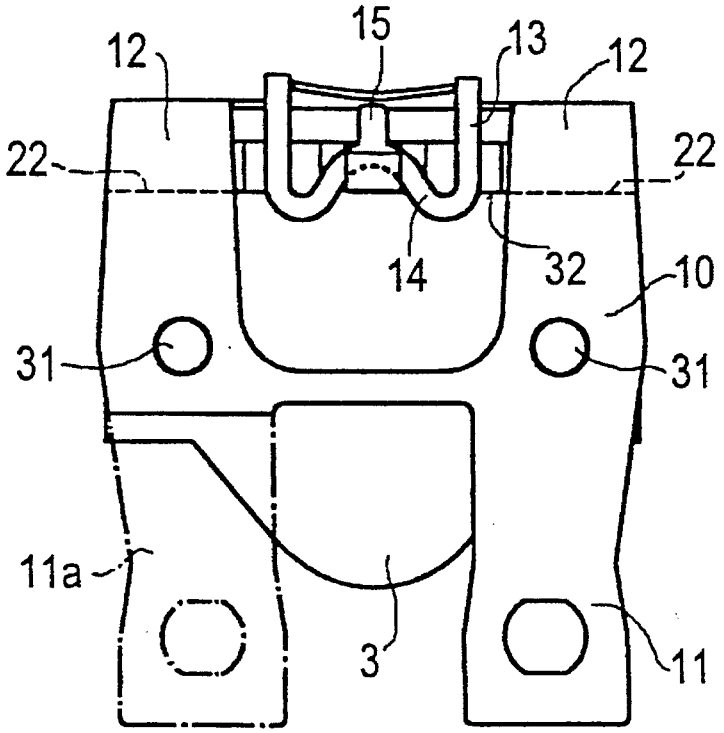
FIG. 4 illustrates a front elevation view from the right-hand end face of the armature mount of FIG. 1.

The armature spring 10 has a contact section or contact spring 11 extending integrally therefrom. The free end of this contact spring 11 carries contact pieces 5 that can be switched between two spaced cooperating contact elements 6 and 7. An optional second contact section or contact spring 11*a* shown with broken lines in FIG. 4 can, for example, serve for bridge or double contacting. The current supply to the contact spring ensues via a stranded conductor 8 and a terminal element that is not shown.

The armature 3 has its armature end face coupled against a broad surface of the yoke leg 21 that faces toward the core. At a yoke end face 23, the yoke leg 21 thereby forms a bearing edge 22 which, however, is fashioned in the form of two edge sections only at the outer regions of the yoke leg 21. The armature spring 10 cut out frame-like in the bearing region and has a bearing section in the form of two spring webs 12 that are secured to the armature 3, for example by rivets 31, lying on that outside of the armature 3 that faces away from the core. The spring webs 12, together with the armature end face, form an inside edge 32 that lies on the bearing edge 22. The yoke end face 23 of the yoke leg 21 is thereby slightly bevelled, so that the bearing edge has an angle of somewhat less than 90° in cross section in order to assure the free mobility of the armature 3 with the spring webs 12 on the bearing edge 22.

The armature spring 10 is preferably composed of a harder material than the soft iron of the yoke 2, for example of stainless steel. In this way, a good bearing property derives to the pairing of materials of the yoke on the one hand and the armature spring on the other hand.

The yoke leg 21 is slightly lengthened between the two spring webs 12 and thus forms respective yoke steps 24 that secure that armature against lateral blows and additionally improve the magnetic coupling of the armature 3 to the yoke leg 21. The width of the yoke steps 24, however, is selected such that a spacing from the spring webs 12 respectively remains in order to avoid frictional motion between the spring webs 12 and the respective yoke steps 24.

Extending from end face 23 and between the two yoke steps 24, the yoke leg 21 has a salient retainer peg 25. The retainer peg 25 has an engagement point or notch 26 for engaging a pre-stress section 13 of the armature spring 10. By a central cutout or central recess 17, this pre-stress section 13 is fashioned to a spring clip having a comparatively narrow web width and, thus, a small cross section, so that it has a soft spring characteristic. A cross-web 14 of the spring clip lying in the insertion notch 26 of the retainer peg 25 is also drawn arcuately inward, as a result whereof the spring clip, and with it, the armature, is centered. A mounting clip 15 with whose assistance the spring clip is grasped during assembly and can be hooked in is also applied to the cross-web 14.

An end section 16 of the armature spring 10 is disposed generally parallel to the yoke leg 21 opposite the armature 3, facing away from the core. The end section 16 integrally connects the spring webs 12 to the spring clip or pre-stress section 13. The end section 16 is spaced from the yoke leg 21. As a result thereof, this end section 16 of the spring 10 can bend given armature movement, so that the spring characteristic becomes softer overall.

The spring webs 12 forming the bearing section and the spring clip 13 are thus respectively bent off out of the plane of the end section 16 at about a right angle in the direction toward the armature, but offset relative to one another. Pre-stress forces F1 and F2 are thereby developed with a lever arm formed by the distance of the insertion notch 26 from the bearing edge 22. Due to the oppositely directed spreading of the spring webs 12 on the one hand and of the spring clip 13 on the other hand, the combination of armature and armature spring is pressed against the bearing edge 22 in two directions with the forces F1 and F2.

Additionally, the position of the attachment point in the notch 26 creates a pre-stress moment for the armature with respect to its pivot point at the inside edge 32, the quiescent contacting force being defined as a result thereof. The position of the notch 26 can be adjusted via an adjustment notch 27. The cross section of the retainer peg 25 is attenuated, forming the adjustment notch 27. At the adjustment notch, the retainer peg 25 can be deformed as indicated by the double arrow 28 in order to adjust a desired position of the notch 26 and, thus, the set the amount of pre-stress.

When the armature 3 is in its normal position, the spring clip or pre-stress section 13 is slightly out of the general plane of the common end section 16 in the position held by the retainer peg 25. This applies a moment about the spring 10 resulting in the preferred normal biasing of the armature 3 away from the coil core 1 so that the contact piece 5 contacts against the contact element 7. There is no movement of the armature 3 relative to the spring 10, resulting in low friction. Also, the pivotal bearing of the armature 3 at its edge 32 against the edge 22 of the yoke leg 21 combined with the minimal contact of the spring 10 against the yoke leg 21 in that region results in low friction as well.

It should be understood that various changes and modifications to the presently preferred embodiments will be apparent to those skilled in the art. Such changes and modifications may be made without departing from the spirit and scope of the present invention and without diminishing its attendant advantages. Therefore, such changes and modifications are intended to be covered by the appended claims.

What is claimed is:

1. An armature mount for an electromagnetic relay, the armature mount comprising:

a generally plate-like armature having an armature end face;

a flat yoke leg arranged generally parallel to a coil core, the flat yoke leg having:

a broad side facing the armature and the coil core;

a yoke end face, at least one bearing edge being formed by the yoke end face and an adjacent portion of said broad side, the armature end face being seated against the broad side; and at least one retainer peg projecting beyond the end face, whereby the armature is arranged at approximately a right angle relative to the yoke leg and forms a working air gap together with the coil core; and an armature spring having:

a bearing section secured flatly to a side of the armature facing away from the coil core, the bearing section lying on the yoke end face; and a pre-stress section holding the spring at the retainer peg and being seated at the retainer peg at an engagement point with a pre-stress force such that the inside bearing edge formed between the bearing section of the spring and the armature end face is urged in contact against each bearing edge of the yoke leg.

2. An armature mount according to claim 1, wherein:

an angle of each bearing edge between the yoke end face and the broad side is smaller than the angle of the inside bearing edge formed between the armature end face and the bearing section of the spring; and a restoring force for the armature is predetermined by defining the engagement point of the pre-stress section of the spring at the retainer peg.

3. An armature mount according to claim 2, wherein:

the bearing section of the armature spring is generally at a right angle relative to the armature end face; and the yoke end face is beveled, such that the angle of each bearing edge between the yoke end face and the broad side is less than 90°.

4. An armature mount according to one claim 1, wherein the engagement point of the pre-stress section can be adjusted by deformation of the retainer peg.

5. An armature mount according to claim 4, wherein the retainer peg comprises an adjustment notch disposed between the engagement point and a point of attachment to a remainder of the yoke leg.

6. An armature mount according to claim 1, wherein the pre-stress section and the bearing section are integrally connected side-by-side by a common end section of the armature spring and are lent their pre-stress by opposite, elastic deformation from the plane of the end section of the spring.

7. An armature mount according to claim 6, wherein the common end section of the spring extends generally parallel to the broad side of the yoke leg, and wherein each bearing section and the pre-stress section are bent off in a generally L-shaped manner to the armature and to the retainer peg, respectively, the pre-stress section and bearing section of the spring being offset from one another along an axial direction relative to the core.

8. An armature mount according to claim 1, wherein:

two bearing edges are provided, being separated from one another and between which the retainer peg extends; and the bearing section of the armature spring comprises two spring webs corresponding to the bearing edges and between which the pre-stress section is cut free.

9. An armature mount according to claim 8, wherein the pre-stress section is shaped by a central cutout to reduce its cross-sectional area and form a spring clip that is supported in an engagement notch located at the engagement point.

10. An armature mount according to claim 8, wherein the common end section of the spring extends generally parallel to the broad side of the yoke leg, and wherein each bearing section and the pre-stress section are bent off in a generally L-shaped manner to the armature and to the retainer peg, respectively, the pre-stress section and bearing section of the spring being offset from one another along an axial direction relative to the core.

11. An armature mount according to claim 1, wherein the pre-stress section is secured against a dislocation in a direction parallel to the bearing edge at the retainer peg by a non-positive engagement in one another.

12. An armature mount according to claims 1, wherein the armature spring further comprises an integrally projecting contact spring extending beyond the movable armature.

13. A relay system comprising:

a coil core aligned on an axis;

a generally flat armature movably operable relative to an end of the coil core and being generally perpendicular to said axis, the armature having an armature end face;

a generally planar yoke leg including:

an underside surface of said yoke leg being positioned generally parallel to said axis and facing toward said coil core, said armature end face contacting against said underside surface so that an edge of said armature end face is generally flush with said yoke end face;

at least one yoke end face being disposed at an end of said yoke leg; and a retainer peg extending beyond said yoke end face generally parallel to said axis;

an integral armature spring including:

a common end section spaced from the yoke leg opposite the coil core;

at least one bearing section extending from said common end section and being shaped around said yoke end face to extend to said armature and being secured to said armature;

a pre-stress section extending from said common end section and engaging against said retainer peg, said engagement causing a bias in said spring urging said armature end face against said underside surface and urging said armature to a normal position relative to said coil core; and at least one contact section extending from said bearing section; and a pair of spaced contact elements associated with each spring contact section, each contact section being alternately movable into contact with one of said associated contact elements.

14. A relay system according to claim 13, wherein said yoke end face is at an angle less than 90° relative to said underside surface.

15. A relay system according to claim 13, wherein said pre-stress section is formed by a cutout in said armature spring, said cutout defining a separation between two said bearing sections.

16. A relay system according to claim 13, wherein said common end section is generally disposed in a plane parallel to said yoke leg, each bearing section having an L-shaped bend toward said armature approximately at said yoke end face, and said pre-stress portion having an L-shaped bend toward said retainer peg axially beyond said yoke end face, an amount of spring bias corresponding to an amount of deflection of said pre-stress section relative to said bearing section.

17. A relay system according to claim 13, wherein said retainer peg is bendable to vary a point of engagement with said pre-stress section in order to selectively adjust said spring bias.

18. A relay system according to claim 17, wherein said retainer peg has an engagement notch for retaining said pre-stress section at a predetermined engagement point.

19. A relay system according to claim 18, wherein said retainer peg is deflectable at an adjustment notch formed by a section of reduced cross-sectional area.

20. A relay system according to claim 13, wherein two said contact sections are provided, each being contiguous with an associated bearing section.

* * * * *